United States Patent [19]

Morgan et al.

[11] 4,184,945

[45] Jan. 22, 1980

[54] MICROWAVE WALL OVEN AIR FLOW SYSTEM

[75] Inventors: Thomas J. Morgan, Maple Lake; Anil Marfatia, Minneapolis; William G. Kullman, Wayzata, all of Minn.

[73] Assignee: Litton Systems, Inc., Minneapolis, Minn.

[21] Appl. No.: 914,485

[22] Filed: Jun. 12, 1978

[51] Int. Cl.[2] ..... H05B 9/06

[52] U.S. Cl. ..... 219/10.55 D; 126/198; 219/10.55 R

[58] Field of Search ..... 219/10.55 D, 10.55 B, 219/10.55 R, 396, 400, 522; 126/198, 193

[56] References Cited

U.S. PATENT DOCUMENTS

| | | | |
|---|---|---|---|
| 3,057,341 | 10/1962 | Perl | 126/198 |
| 3,430,023 | 2/1969 | Tingley | 219/10.55 D |
| 3,711,673 | 1/1973 | Takeda et al. | 219/10.55 D |
| 3,835,283 | 9/1974 | Suzuki | 219/10.55 D |
| 3,889,100 | 6/1975 | Dills | 126/198 X |
| 3,911,893 | 10/1975 | Baker et al. | 126/198 X |
| 4,096,369 | 6/1978 | Tanaka et al. | 219/10.55 B X |

*Primary Examiner*—Arthur T. Grimley

*Attorney, Agent, or Firm*—Robert E. Lowe; James A. Niegowski

[57] ABSTRACT

An air flow system for use in a wall-mount microwave oven is disclosed. A housing of the microwave oven has an interior which is divided into a cooking cavity and an electronic component compartment. A front face of the housing is comprised of a movable door and a control panel. A circuit board for holding electronic components is mounted within the electronic component compartment so that it is spaced from the control panel. An air passageway is defined in the area between the control panel and the circuit board. An air inlet is disposed adjacent an upper end of the control panel for admitting air into the electrical component compartment and an air outlet is disposed adjacent a lower end of the control panel for allowing air to exit from the electrical component compartment. A blower draws air in through the air inlet, and forces the air through the electrical component compartment, and out the air outlet. A mechanism diverts a portion of the air being drawn in through the inlet to the air passageway. Air also is directed through the electronic component compartment past the magnetron and the transformer. A duct mechanism carries air from the electronic component compartment to the air outlet.

15 Claims, 4 Drawing Figures

MICROWAVE WALL OVEN AIR FLOW SYSTEM

BACKGROUND OF THE INVENTION

The present invention relates to an air flow system used in a microwave oven. A majority of the prior art microwave ovens have been countertop ovens designed to operate while resting upon a countertop. Numerous air flow systems have been utilized in countertop microwave ovens. U.S. Pat. Nos. 3,654,417; 3,681,557; 3,783,219; and 3,829,649 illustrate various air flow systems utilized with countertop microwave ovens of the prior art.

Conventional ovens, in addition to being made in a free-standing style, have been designed to be mounted in a wall. The mounting of a conventional oven within a wall requires that a unique ventilation or air flow system be utilized. Heat must be dissipated out of the wall cavity so that an undue heat build-up is not created within a wall cavity. A ventilating system is especially required where the conventional wall-mounted oven is of the self-cleaning type. In a self-cleaning operation, heat in excess of the normal baking or broiling heat is generated and, hence, must be forced out of the wall cavity. U.S. Pat. Nos. 3,882,843; 3,911,893 and 3,924,601 illustrate several air flow systems used in wall-mounted conventional ovens.

When a microwave oven is mounted in a wall, the air flow systems which are generally utilized in countertop microwave ovens are unsuitable. When the microwave oven is mounted within a wall above a conventional oven, the problem of dissipating heat generated during cooking is increased. The heat dissipation problem is especially difficult when the lower oven is in an open-door broiling operation and a microwave oven mounted above the conventional oven is also operating. During such operation, heat rises from the lower conventional oven and can heat the electronic components of the microwave oven which are already in a heated condition due to their normal operation.

SUMMARY OF THE INVENTION

The present invention relates to an air flow system for use in a wall-mount microwave oven. A housing of the microwave oven has an interior which is divided into a cooking cavity and an electronic component compartment. A front face of the housing is comprised of a movable door and a control panel. A circuit board for holding electronic components is mounted within the electronic component compartment so that it is spaced from the control panel. An air passageway is defined in the area between the control panel and the circuit board. An air inlet is disposed adjacent an upper end of the control panel for admitting air into the electrical component compartment and an air outlet is disposed adjacent a lower end of the control panel for allowing air to exit from the electrical component compartment. A blower draws air in through the air inlet, and forces the air through the electrical component compartment and out the air outlet. A mechanism diverts a portion of the air being drawn in through the inlet to the air passageway. Air also is directed through the electronic component compartment past the magnetron and the transformer. A duct mechanism carries air from the electronic component compartment to the air outlet.

In the preferred embodiment a dividing plate is supported in the electronic component compartment in a generally horizontal disposition. The magnetron is supported above the dividing plate and the transformer is supported below the dividing plate. The dividing plate thus forms a first plenum for passing air past the magnetron and a second plenum for passing air past the transformer. A first blower fan is mounted adjacent the magnetron for blowing air through the first plenum and a second blower fan is mounted adjacent the transformer for blowing air through the second plenum. The two plenums communicate with the duct mechanism which carries the air from the back of the microwave oven to the air outlet which is located at the front face of the microwave oven. The microwave oven is supported above a conventional oven and a portion of the duct means passes between the bottom of the housing and the top of the conventional oven.

Various advantages and features of novelty which characterize the invention are pointed out with particularity in the claims annexed hereto and forming a part hereof. However, for a better understanding of the invention, its advantages, and objects obtained by its use, reference should be had to the drawing which forms a further part hereof, and to the accompanying descriptive matter, in which there is illustrated and described a preferred embodiment of the invention.

DETAILED DESCRIPTION OF THE INVENTION

Figure 1:
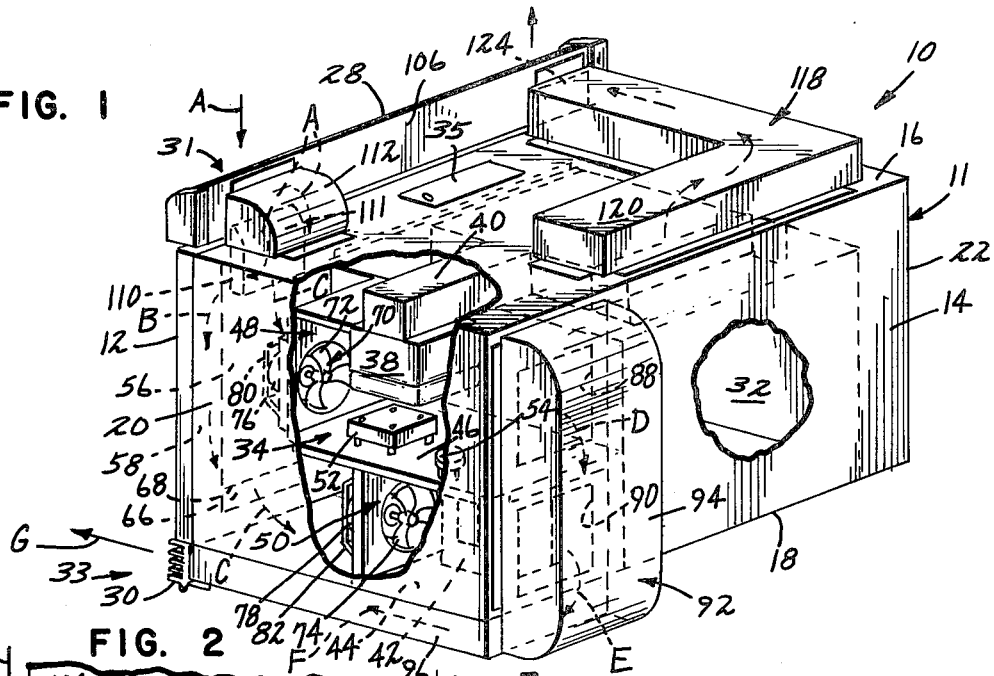
FIG. 1 is a perspective view of a wall-mount microwave oven according to the present invention with portions broken away for clarity.

Referring to the drawings in detail, wherein like numerals indicate like elements, there is shown in FIG. 1 a microwave oven in accordance with the present invention designated generally as 10. The microwave oven 10 includes a housing 11 which has a front face 12, a back face 14, a top face 16, a bottom face 18, and side faces 20, 22. The front face 12 includes a pivotable door 24, a control panel 26 and upper and lower trim pieces 28, 30. A door latch release 39 extends outwardly from the control panel 26 to release a door latch (not shown) and thereby allow the door 24 to open. An air inlet means 31 is formed in the front face 12 adjacent the top of the control panel 26. An air outlet means 33 is formed in the front face 12 adjacent the bottom of the control panel 26.

The interior of the housing 11 is divided into a cooking cavity 32 and an electronic component compartment 34. A light casing 35 is provided in the top face 16 to hold a light bulb (not shown) for illuminating the cooking cavity 32. A dividing means 36, such as a wall or partition, divides the interior into the cooking cavity 32 and the electronic component compartment 34. The cooking cavity 32 is bounded by six walls with one of the walls being formed by an interior surface of the door 24.

The electronic component compartment 34 contains the various electronic components for generating and controlling the electromagnetic wave energy utilized in the cooking process. Since the electronic components utilized in the microwave oven 10 are conventional, only several of the electronic components which are necessary for understanding the present invention will be illustrated. A magnetron 38 is supported in an upper area of the electronic component compartment 34. The magnetron 38 generates microwave energy which travels within a wave guide 40 to the cooking cavity 32. A transformer 42 is supported upon a base 44 of the electronic component compartment 34. A dividing plate 46 is supported in a generally horizontal disposition between the magnetron 38 and the transformer 42. As best seen in FIG. 1, the dividing plate 46 extends between and contacts the side face 20, the dividing means 36, and the back face 14. In this manner, a first plenum 48 is created around the magnetron 38 and a second plenum 50 is created around the transformer 42. The dividing plate 46 also serves to support some electronic components, such as a capacitor 52 and a diode 54.

A circuit board 56 has a number of other electronic components mounted on it. The circuit board 56 is mounted to a control panel partition 58. The control panel partition 58 is mounted generally parallel to and in a spaced relationship from the control panel 28. A generally rectangular-shaped hole 60 is formed in the control partition 58. A major portion of the circuit board 56 is received within the hole 60 and is secured to the partition 58 along two side edges of the hole 60. In this manner, an air passageway 61 is formed in the area between the control panel 26 and the circuit board 56. The length or the transverse dimension of the circuit board 56 in a first direction is less than the length or transverse dimension of the hole 60 in a corresponding direction. The circuit board 56 is positioned medially within the hole 60 so that an inlet slot 62 is formed by the hole 60 at the upper edge 64 of the circuit board 56. By positioning the circuit board 56 medially of the hole 60, an outlet slot 66 is formed by the hole 60 at the lower edge 68 of the circuit board 56. In a manner to be explained more fully hereinafter, air may thus be drawn in through the inlet slot 62 and passed down the passageway 61 to cool the electronic components on the circuit board 56, and thereafter be drawn out the outlet slot 66 into the remaining portion of the electronic component compartment 34 which is disposed rearward of the circuit board 56.

A blower means, designated generally as 70, is supported in the electronic component compartment 34. In the preferred embodiment, a first blower fan 72 and a second blower fan 74 are used to draw air through the electronic component compartment 34. A first drive motor 76 drives the first blower fan 72 and a second drive motor 78 drives the second blower fan 74. The first blower fan 72 and drive motor 76 are supported on a bracket 80 which is attached to the dividing plate 46. The blower fan 72 is supported adjacent the magnetron 38 in order to create an air flow through the first plenum 48 and past the magnetron 38. The blower fan 74 and motor 78 are supported by a bracket 82 which rests upon the base 44. The blower fan 74 is disposed adjacent the transformer 42 to create an air flow through the second plenum 50 and past the transformer 42.

A first plenum exhaust port 88 is formed in the back face 14 and communicates with the first plenum 48. A second plenum exhaust port 90 is formed in the back face 14 and communicates with the second plenum 50. Separate and discrete exhaust ports 88, 90 are thus provided for each of the plenums 48, 50. The exhaust ports 88, 90 communicate with a duct means, designated generally as 92, which carries or directs the air exiting the electronic component compartment 34 to the outlet means 33. The duct means 92 includes a first duct 94 and a second duct 96. The first duct 94 extends generally vertically along the back face 14. The first duct 94 has a width substantially equal to the width of the electronic component compartment 34 and communicates with the exhaust ports 88, 90. The second duct 96 extends generally horizontally below the bottom face 18 and also has a width substantially equal to the width of the electronic component compartment 34. The second duct 96 is in direct communication with the first duct 94 and passes air leaving the electronic component compartment 34 to the air outlet means 33. The lower trim piece 30 extends across substantially the entire front face 12. The trim piece 30 includes a plurality of horizontally disposed and vertically spaced slats 100. Since the second duct 96 is substantially equal in width to the width of the electronic component compartment 34, a stream of air also having a width substantially equal to the width of the electronic component compartment 34 and the control panel 26 passes horizontally outward between the slats 100.

The trim piece 28 extends along the upper edge of the front face 12. An opening 104 extends along the lengthwise dimension of the upper surface of trim piece 28. A rectangular-shaped panel 106 is supported above the uppermost edge of the door 24 and the control panel 26. The trim piece 28 is attached to the panel 106. The air inlet means 31 includes an air inlet aperture or slot 108. The inlet aperture 108 is formed in the panel 106 in an area above the control panel 26. A conduit 110 is attached to the circuit board 56 adjacent its upper edge 64. The conduit 110 forms a sealed passage and provides fluid communication between the air inlet aperture 108 and the inlet slot 62 to the air passageway 61. The conduit 110 is preferably made of fiberboard and shaped in a configuration of a box having a curved inlet 111. A portion of the air entering through the air inlet aperture 108 is thus diverted directly to the air passageway 61. The remainder of the air entering through the air inlet aperture 108 moves directly into the portion of the electronic component compartment 34 which is rearward of the circuit board 56. An air inlet baffle 112 takes on a generally downwardly curved configuration to aid in directing incoming air to the electronic component compartment 34 and downwardly toward the magnetron 38 and the transformer 42.

The first and second blower fans 72, 74 create a negative pressure at both the air inlet aperture 108 and the outlet slot 66. In this manner air is drawn in through the air inlet aperture 108, as shown by arrows A, and through the air passageway 61, as shown by arrows B. As shown by arrows C, the blower fans 72, 74 draw the air through a portion of the electronic component compartment 34 which is rearward of the circuit board 56. Thereafter, as shown by arrows D, the first blower fan 72 forces the air by the magnetron 38, through the first plenum 48 and out the exhaust port 88 into the first duct 94. As shown by arrows E, the second blower fan 74 forces air past the transformer 42, through the second plenum 50 and out of the exhaust port 90 into the first duct 94. The air exiting the exhaust ports 88, 90 thereafter passes through the first and second ducts 94, 96 as is shown by arrows F, and out the outlet means 33, as is shown by arrow G.

Figure 3:
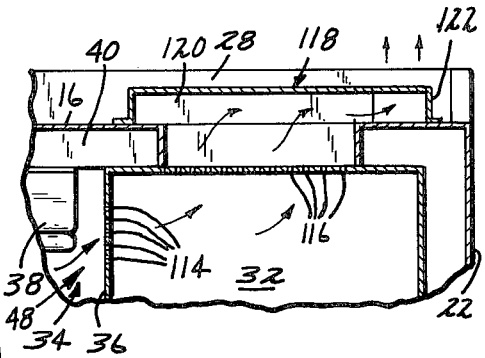
FIG. 3 is a view taken along lines 3—3 of FIG. 2.
Figure 4:
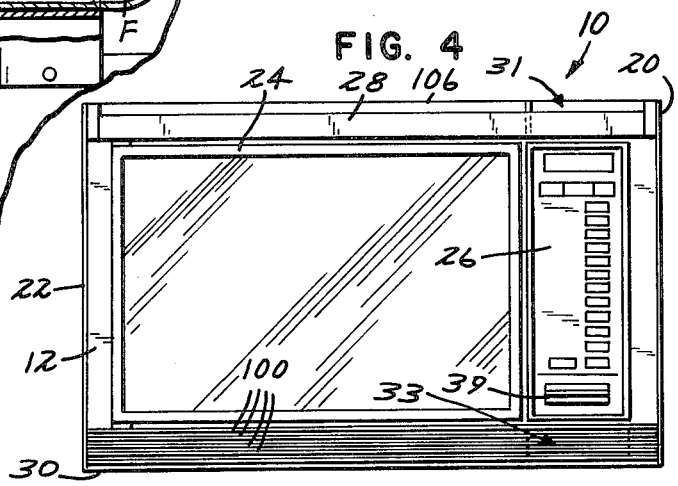
FIG. 4 is a front elevational view of the microwave oven shown in FIG. 1.

Apertures 114 are formed in the dividing means 36 adjacent the magnetron 38. A portion of the air passing through the first plenum 48 is thus diverted into the cooking cavity 32. As seen in FIG. 3, a plurality of apertures 116 are formed in a top wall of the cooking cavity 32. A steam outlet duct 118 is supported above the top face 16. A first leg 120 of the steam outlet duct 118 is disposed above and in communication with the apertures 116. A second leg 122 of the steam outlet duct 118 extends along the side of the top face 16 and has an opening in communication with a steam outlet aperture 124 which is formed in the panel 106. A heated forced air flow is formed through the cooking cavity 32 and out the steam outlet duct 118.

Figure 2:
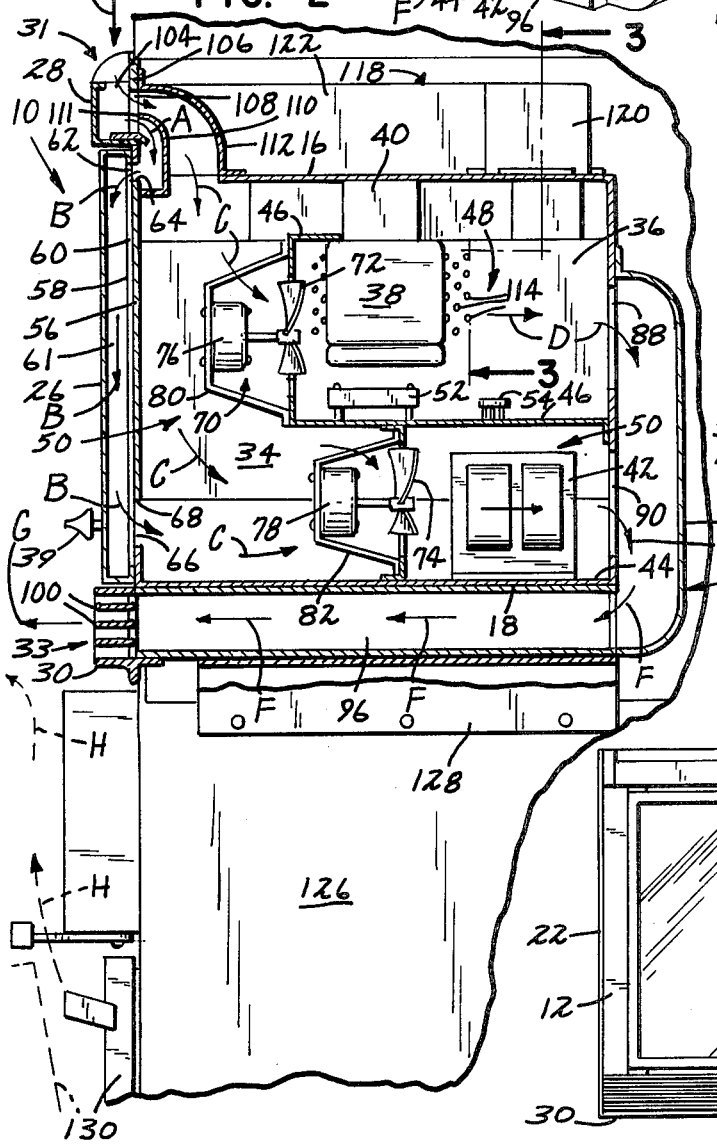
FIG. 2 is a side sectional view of the oven illustrated in FIG. 1 illustrating the microwave oven mounted above a conventional wall-mount oven.

As best seen in FIG. 2, the microwave oven 10 is mounted above a conventional oven 126. The microwave oven 10 is mounted above the conventional oven 126 by any suitable means, such as by bolting or welding to mounting flange 128. A door 130 of the oven 126 is shown in full line in a closed position in FIG. 2. In phantom line with FIG. 2, the door 130 is shown in a partially open position. The door 130 is generally placed in the partially open position when the lower oven is being used for open door broiling. If the microwave oven 10 is also operating at such a time, this represents the worst heating conditions which the various electronic components of the microwave oven 10 will undergo. The air flow system of the present invention is especially designed to keep the various electronic components of the microwave oven 10 cool even in this condition. As is noted above, the air which passes through the electronic component compartment and exits the air outlet means 33 exits in a stream which is substantially as wide as the control panel 26. The air exiting the air outlet means 33 is illustrated by arrow G. The hot air which exits the oven 126 during open door broiling is illustrated by the dotted arrows H. The air (G) leaving the air outlet means 33 thus forces the hot air (H) which is leaving the lower oven 126 away from the control panel 26 and the electronic component compartment 34. During the worst possible operating conditions, the air flow system of the present invention provides both an air flow across the electronic components of the microwave oven 10 and a means for keeping the hot air exiting the conventional oven 126 away from the electronic components of the control panel 26. The air (G) also keeps the hot air (H) away from the air inlet means 31. In this manner, the ambient air surrounding and entering through the air inlet means 31 is kept cool.

The operation of the microwave oven and the air flow system of the present invention should be self-explanatory from the above discussion. The blower fans 72, 74 are operatively coupled to the on-off switch of the microwave oven 10. Thus, whenever the microwave oven 10 is turned on, the blower fans 72, 74 are also turned on.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent extended by the broad general meaning of the terms in which the appended claims are expressed.

What is claimed is:

1. An air flow system for a wall-mount microwave oven comprising:

a housing having an interior divided into a cooking cavity and an electronic component compartment;

means for dividing said interior into said cooking cavity and said electronic component compartment;

said housing having a front face comprised of a movable door and a control panel, a back face, a top face, a bottom face, and a pair of side faces;

said cooking cavity being bounded by walls, one of said walls being an interior surface of said door;

said electronic component compartment having electronic control components including a transformer and a magnetron mounted therein;

a circuit board for holding at least some of said electronic components, said circuit board being mounted within said electronic component compartment;

means for mounting said circuit board in said electronic component compartment in a spaced relationship from said control panel;

an air passageway being defined in an area between said control panel and said circuit board;

means for supporting said magnetron within said electronic control compartment in a spaced relationship from said transformer;

wave guide means communicating between the magnetron in said electronic component compartment and said cooking cavity for supplying electromagnetic wave energy produced by said magnetron to said cooking cavity;

air inlet means disposed adjacent an upper end of said control panel for admitting air into said electronic component compartment;

air outlet means disposed adjacent a lower end of said control panel for allowing air to exit from said electronic component compartment;

blower means for moving air in through said air inlet means, through said electronic component compartment, and out said air outlet means;

means for diverting a portion of the air being drawn in through said air inlet means to said air passageway so that a portion of the air entering said electronic component compartment passes directly to said air passageway and by the electronic components mounted on the circuit board;

means for directing air passing through said electronic component compartment past said magnetron and said transformer; and duct means for carrying air from said electronic component compartment to said air outlet means.

2. An air flow system in accordance with claim 1 wherein said air inlet means includes an inlet aperture formed in said front face and said diverting means includes a conduit having one open end in communication with said inlet aperture and another open end in communication with said air passageway.

3. An air flow system in accordance with claim 2 wherein said circuit board mounting means includes a control panel partition spaced from and generally parallel to said control panel, said control panel partition having a hole extending through it, said circuit board being mounted to said control panel partition so that a major portion of the circuit board is received within said hole and is held generally parallel to said control panel, said circuit board having a transverse dimension less than a transverse dimension of said hole, said circuit board being positioned within said hole so that an air inlet slot is formed through said hole adjacent an upper edge of said circuit board and an air outlet slot is formed through said slot adjacent a lower edge of said circuit board, said conduit being in communication with said air inlet slot and said air outlet slot being in communication with a portion of said electronic component compartment rearward of said circuit board whereby air drawn into said conduit passes through said air inlet slot, through said air passageway and out said air outlet slot into said portion of the electronic component compartment.

4. An air flow system in accordance with claim 1 including an inlet baffle disposed adjacent said air inlet means for diverting a portion of said air which is not diverted to said air passageway to said portion of the electronic component compartment and wherein said air directing means includes means for supporting said blower means upstream of said magnetron so that said blower means creates a negative pressure adjacent said inlet baffle and in said air passageway to draw air through said inlet baffle and said air passageway and thereafter through said portion of the electronic component compartment and past said magnetron and said transformer.

5. An air flow system in accordance with claim 4 wherein said air directing means includes a dividing plate supported in said electronic component compartment and positioned between said transformer and said magnetron, said dividing plate dividing said electronic component compartment into a first plenum around said magnetron for passing a first stream of air by said magnetron and a second plenum around said transformer for passing a second stream of air by said transformer, a first outlet port through said back face for providing communication between said first plenum and said duct means and a second outlet port through said back face for providing communication between said second plenum and said duct means.

6. An air flow system in accordance with claim 5 wherein said dividing plate is generally horizontally disposed, said magnetron is supported above said dividing plate and said transformer is supported below said dividing plate, and said blower means includes a first blower fan supported above said dividing plate adjacent said magnetron and a second blower fan supported below said dividing plate adjacent said transformer.

7. An air flow system in accordance with claim 1 wherein said blower means includes a first blower fan for blowing air past said magnetron, said first blower fan being supported in said electronic component compartment adjacent said magnetron, and a second blower fan for blowing air past said transformer, said second blower fan being supported in said electronic component compartment adjacent said transformer.

8. An air flow system in accordance with claim 1 including a plurality of apertures formed through said dividing means, said apertures providing communication between said electronic component compartment and said cooking cavity for passing a portion of the air moving through said electronic component compartment to said cooking cavity, a plurality of holes formed in a top wall of said cooking cavity, and a steam outlet duct having one end in communication with said holes in the top wall and another end in open communication with a steam outlet aperture through said front face.

9. An air flow system in accordance with claim 1 including an oven and a means for mounting said housing above said oven.

10. An air flow system in accordance with claim 9 wherein said duct means includes a first vertically extending duct and a second horizontally extending duct, said first duct extending along said back face and being in communication with a port formed in said back face, said second duct extending along and below said bottom face and between said bottom face and said oven, a first end of said second duct communicating with an end of said first duct and a second end of said second duct communicating with said air outlet means, said second end having a width substantially equal to the width of said control panel whereby air exiting said air outlet means leaves in a path having a width substantially equal to the width of said control panel to blow hot air exiting said oven away from said control panel.

11. An air flow system in accordance with claim 1 wherein said duct means includes a first vertically extending duct and a second horizontally extending duct, said first duct extending along said back face and being in communication with a port formed in said back face, said second duct extending along and below said bottom face, a first end of said second duct communicating with an end of said first duct and a second end of said second duct communicating with said air outlet means, said second end having a width substantially equal to the width of said control panel whereby air exiting said air outlet means leaves in a path having a width substantially equal to the width of said control panel.

12. An air flow system for a wall-mount microwave oven comprising:

a housing, having an interior divided into a cooking cavity and an electronic component compartment;

means for dividing said interior into said cooking cavity and said electronic component compartment;

said housing having a front face comprised of a movable door and a control panel, a back face, a top face, a bottom face, and a pair of side faces;

said cooking cavity being bounded by walls, one of said walls being an interior surface of said door;

said electronic component compartment having electronic control components including a transformer and a magnetron mounted therein;

an air inlet aperture formed in said front face and disposed adjacent an upper end of said control panel for admitting air into said electronic component compartment;

air outlet means disposed adjacent a lower end of said control panel for allowing air to exit from said electronic component compartment;

a circuit board for holding at least some of said electronic components;

a control panel partition mounted in said electronic component compartment spaced from and generally parallel to said control panel, said control panel partition having a hole extending through it;

said circuit board being mounted to said control panel partition so that a major portion of the circuit board is received within said hole and is held spaced from and generally parallel to said control panel;

said circuit board having a transverse dimension less than a transverse dimension of said hole, said circuit board being positioned within said hole so that an air inlet slot is formed through said hole adjacent an upper edge of said circuit board and an air outlet slot is formed through said slot adjacent a lower edge of said circuit board;

an air passageway being defined in an area between said control panel and said circuit board;

means for supporting said magnetron within said electronic control compartment in a spaced relationship from said transformer;

wave guide means communicating between the magnetron in said electronic component compartment and said cooking cavity for supplying electromagnetic wave energy produced by said magnetron to said cooking cavity;

blower means for moving air in through said air inlet means, through said electronic component compartment, and out said air outlet means;

means for diverting a portion of the air being drawn in through said air inlet means to said air passageway so that a portion of the air entering said electronic component compartment passes directly to said air passageway and by the electronic components mounted on the circuit board;

said diverting means including a conduit having one open end in communication with said inlet aperture and another open end in communication with said air inlet slot;

said air outlet slot being in communication with a portion of said electronic component compartment rearward of said circuit board whereby air drawn into said conduit passes through said air inlet slot, through said air passageway and out said air outlet slot into said portion of the electronic component compartment;

means for directing air passing through said electronic component compartment past said magnetron and said transformer; and duct means for carrying air from said electronic component compartment to said air outlet means.

13. An air flow system in accordance with claim 12 wherein said air directing means includes a dividing plate supported generally horizontally in said electronic component compartment and positioned between said transformer and said magnetron, said magnetron being supported above said dividing plate and said transformer being supported below said dividing plate, said dividing plate dividing said electronic component compartment into a first plenum around said magnetron for passing a stream of air by said magnetron and a second plenum around said transformer for passing a second stream of air by said transformer, a first outlet port through said back face for providing communication between said first plenum and said duct means, a second outlet port through said back face for providing communication between said second plenum and said duct means, and said blower means including a first blower fan supported above said dividing plate adjacent said magnetron and a second blower fan supported below said dividing plate adjacent said transformer.

14. An air flow system in accordance with claim 13 including an oven and a means for mounting said housing above said oven and wherein said duct means includes a first vertically extending duct and a second horizontally extending duct, said first duct extending along said back face and being in communication with said ports formed in said back face, said second duct extending along and below said bottom face and between said bottom face and said oven, a first end of said second duct communicating with an end of said first duct and a second end of said second duct communicating with said air outlet means, said second end having a width substantially equal to the width of said control panel whereby air exiting said air outlet means leaves in a path having a width substantially equal to the width of said control panel to blow hot air exiting said oven away from said control panel.

15. An air flow system for a wall-mount microwave oven comprising:

a housing, having an interior divided into a cooking cavity and an electronic component compartment;

means for dividing said interior into said cooking cavity and said electronic component compartment;

said housing having a front face comprised of a movable door and a control panel, a back face, a top face, a bottom face, and a pair of side faces;

said cooking cavity being bounded by walls, one of said walls being an interior surface of said door;

said electronic component compartment having electronic control components including a transformer and a magnetron mounted therein;

a circuit board for holding at least some of said electronic components;

means for mounting said circuit board in said electronic component compartment in a spaced relationship from said control panel;

an air passageway being defined in an area between said control panel and said circuit board;

means for supporting said magnetron within said electronic control compartment in a spaced relationship from said transformer;

wave guide means communicating between the magnetron in said electronic component compartment and said cooking cavity for supplying electromagnetic wave energy produced by said magnetron to said cooking cavity;

air inlet means disposed adjacent an upper end of said control panel for admitting air into said electronic component compartment;

air outlet means disposed adjacent a lower end of said control panel for allowing air to exit from said electronic component compartment;

blower means for moving air in through said air inlet means, through said electronic component compartment, and out said air outlet means;

means for diverting a portion of the air being drawn in through said air inlet means to said air passageway so that a portion of the air entering said electronic component compartment passes directly to said air passageway and by the electronic components mounted on the circuit board;

means for directing air passing through said electronic component compartment past said magnetron and said transformer;

an oven and means for mounting said housing above said oven; and duct means for carrying air from said electronic component compartment to said air outlet means, said duct means passing between said housing and said oven and passing air exiting said air outlet means in a path substantially equal to the width of said control panel.

* * * * *